US009750971B1

(12) United States Patent
Humphrey

(10) Patent No.: US 9,750,971 B1
(45) Date of Patent: Sep. 5, 2017

(54) PEDAL ACTIVATED LIFT ADVANTAGE WEIGHT LIFTING BENCH APPARATUS

(71) Applicant: Damon Joseph Humphrey, San Diego, CA (US)

(72) Inventor: Damon Joseph Humphrey, San Diego, CA (US)

(73) Assignee: Damon J. Humphrey, San Diego, CA (US)

( * ) Notice: Subject to any disclaimer, the term of this patent is extended or adjusted under 35 U.S.C. 154(b) by 0 days.

(21) Appl. No.: 15/254,864

(22) Filed: Sep. 1, 2016

(51) Int. Cl.
*A63B 21/078* (2006.01)
*A63B 22/00* (2006.01)
*A63B 21/00* (2006.01)

(52) U.S. Cl.
CPC .... *A63B 22/0017* (2015.10); *A63B 21/00181* (2013.01); *A63B 21/0783* (2015.10)

(58) Field of Classification Search
CPC ..... A63B 22/0017; A63B 21/0783; A63B 21/00181; A63B 21/00058; A63B 21/00178; A63B 21/022; A63B 21/023; A63B 21/078; A63B 21/08; A63B 21/40; A63B 21/4005; A63B 21/4023; A63B 21/4027; A63B 21/4029; A63B 21/4031; A63B 22/0002; A63B 22/0015; A63B 22/0046; A63B 22/0087
USPC ..... 482/142
See application file for complete search history.

(56) References Cited

U.S. PATENT DOCUMENTS 3,874,658 A 4/1975 Flowers
4,256,301 A 3/1981 Goyette
4,411,425 A * 10/1983 Milnar ..... A63B 21/078 248/65
4,471,956 A 9/1984 Mario
4,635,930 A 1/1987 Cormier
4,650,186 A 3/1987 McCreery et al.
4,949,959 A 8/1990 Stevens
5,190,510 A 3/1993 Goodger
5,779,602 A * 7/1998 Rodriguez ..... A63B 21/078 482/104
6,746,379 B1 6/2004 Brawner
6,926,648 B2 8/2005 Capizzo
7,585,259 B2 9/2009 Turner
7,753,830 B1 * 7/2010 Marsh ..... A63B 21/078 482/104
8,066,622 B2 * 11/2011 Kim ..... A63B 21/078 482/130
8,900,097 B1 * 12/2014 Griggs ..... A63B 71/0619 482/4
9,248,337 B1 2/2016 Humphrey
9,327,161 B1 * 5/2016 Maher ..... A63B 21/078
(Continued)

*Primary Examiner* — Andrew S Lo

(57) ABSTRACT

A pedal activated lift advantage weight lifting bench apparatus that includes a pair of arm assists disposed connected to a pair of strut members disposed laterally adjacent to a weight lifting bench in position appropriate for each arm assist to supportively underlie and contact the dorsal side of each of a user's upper arms, whereby a pedal member, disposed in operational communication with each of a pair of uplift members, effects movement of each of said pair of uplift members between a retracted position and an extended position, to forcibly uplift each arm assist against the dorsal side of each of a user's upper arms and thereby assist a bench press without the need of overhead pulleys or another person standing as spotter.

3 Claims, 3 Drawing Sheets

(56) References Cited

U.S. PATENT DOCUMENTS

| | | | | |
|---|---|---|---|---|
| 2003/0114277 | A1* | 6/2003 | Capizzo | A63B 21/4029 482/93 |
| 2004/0162200 | A1 | 8/2004 | Brawner | |
| 2005/0277524 | A1 | 12/2005 | Bae | |
| 2006/0194678 | A1* | 8/2006 | Turner | A63B 21/078 482/94 |
| 2007/0072750 | A1* | 3/2007 | Andrews | A63B 21/0783 482/104 |
| 2010/0130335 | A1 | 5/2010 | Hoobler | |
| 2013/0190143 | A1* | 7/2013 | Greenhill | A63B 21/0611 482/104 |
| 2015/0224359 | A1* | 8/2015 | Kalleen | A63B 71/0054 482/104 |

* cited by examiner

PEDAL ACTIVATED LIFT ADVANTAGE WEIGHT LIFTING BENCH APPARATUS

BACKGROUND OF THE INVENTION

Various types of lift assist weight lifting apparatuses are known in the prior art. Most involve complex arrangements of pulleys disposed to prevent collapse of a user's arms while bench pressing. What is needed, though, is a pedal activated lift advantage weight lifting bench apparatus that includes a pair of arm assists disposed atop to a pair of strut members laterally disposed adjacent a weight lifting bench proper, in a position appropriate for each arm assist to supportively underlie and contact the dorsal side of each of a user's upper arms. At least one pedal member is disposed to effect movement of each of a pair of uplift members disposed between a base plate underlying the weight lifting bench and each of the strut members. Compression of the at least one pedal member is devised to effect movement of each of the pair of uplift members between a retracted position and an extended position whereby each of the pair of arm assists is supportively forcible upwards by a user to assist return of a weight during bench pressing without need of another person standing as spotter.

FIELD OF THE INVENTION

The present invention relates to a pedal activated lift advantage weight lifting bench apparatus, and more particularly, to a pedal activated lift advantage weight lifting bench apparatus that includes a pair of arm assists disposed connected to a pair of strut members disposed laterally adjacent a weight lifting bench proper, in position appropriate for each arm assist to supportively underlie and contact the dorsal side of each of a user's upper arms. At least one pedal is disposed to operationally communicate with each of a pair of uplift members, said uplift members disposed between a base plate underlying the weight lifting bench and each of the pair of strut members. The at least one pedal member is devised to effect movement of each of the pair of uplift members between a retracted position and an extended position. Compression of the pedal member thereby effects extension of each of the pair of uplift members to force each of the pair of strut members upwards, whereby each arm assist forcibly assists in lifting a weight whenever the pedal is engaged by a user.

SUMMARY OF THE INVENTION

The general purpose of the lift assist weight lifting bench, described subsequently in greater detail, is to provide a pedal activated lift advantage weight lifting bench apparatus which has many novel features that result in a pedal activated lift advantage weight lifting bench apparatus which is not anticipated, rendered obvious, suggested, or even implied by prior art, either alone or in combination thereof.

The present pedal activated lift advantage weight lifting bench apparatus has been devised to enable assisted lifting of weights during bench presses by action of at least one pedal member disposed in operational communication with each of a pair of arm assists. Compression of the pedal member by a user enables extension of each of a pair of extension members to forcibly, supportively, uplift each of the pair of arm assists and assist return of the weight without the aid of another person spotting the user.

The present pedal activated lift advantage weight lifting bench apparatus, therefore, includes a weight lifting bench dispositional underlying a weight support, in the manner seen in the bench pressing arts. A user lays supine upon the bench, to rest said user's upper arms upon each of a pair of arm assists—padded members disposed to underlie and conjunct the dorsal side of each of said user's upper arms when said user adopts a posture appropriate for bench pressing an overlying weight.

Each arm assist is connected to a strut member, said strut member disposed laterally adjacent either side of the weight lifting bench. An uplift member is extendably disposed beneath each arm assist, connecting each strut member to a base plate disposed proximally upon an underlying ground surface. Each said uplift member is moveable, by action of at least one pedal member, between a retracted position and an extended position. Each arm assist, therefore, is forcible conjunct the dorsal side of a user's upper arm wherein force applied by action of the at least one pedal member aids in lifting a weight to an uppermost position absent the need of overhead pulleys or a second person standing as spotter.

The at least one pedal member is disposed upon the base plate in a position appropriate for engagement by at least one foot of a user laying supine upon the weight lifting bench. The at least one pedal member operates by hydraulic force, forcing a non-compressible liquid within at least one hydraulic line to force the pair of uplift members between the retracted position and the extended position. It is nonetheless contemplated that the at least one pedal member may alternatively use torque from mechanical leverage to force the pair of uplift members between the retracted and extended positions. Alternatively, it is yet further contemplated that the pedal may engage an electric motor whereby each of the pair of uplift members is electrically actuated between the retracted and extended positions.

Thus has been broadly outlined the more important features of the present pedal activated lift advantage weight lifting bench apparatus so that the detailed description thereof that follows may be better understood and in order that the present contribution to the art may be better appreciated.

Objects of the present lift assist weight lifting bench, along with various novel features that characterize the invention are particularly pointed out in the claims forming a part of this disclosure. For better understanding of the lift assist weight lifting bench, its operating advantages and specific objects attained by its uses, refer to the accompanying drawings and description.

BRIEF DESCRIPTION OF THE DRAWINGS

Figures

DETAILED DESCRIPTION OF THE DRAWINGS

Figure 1:
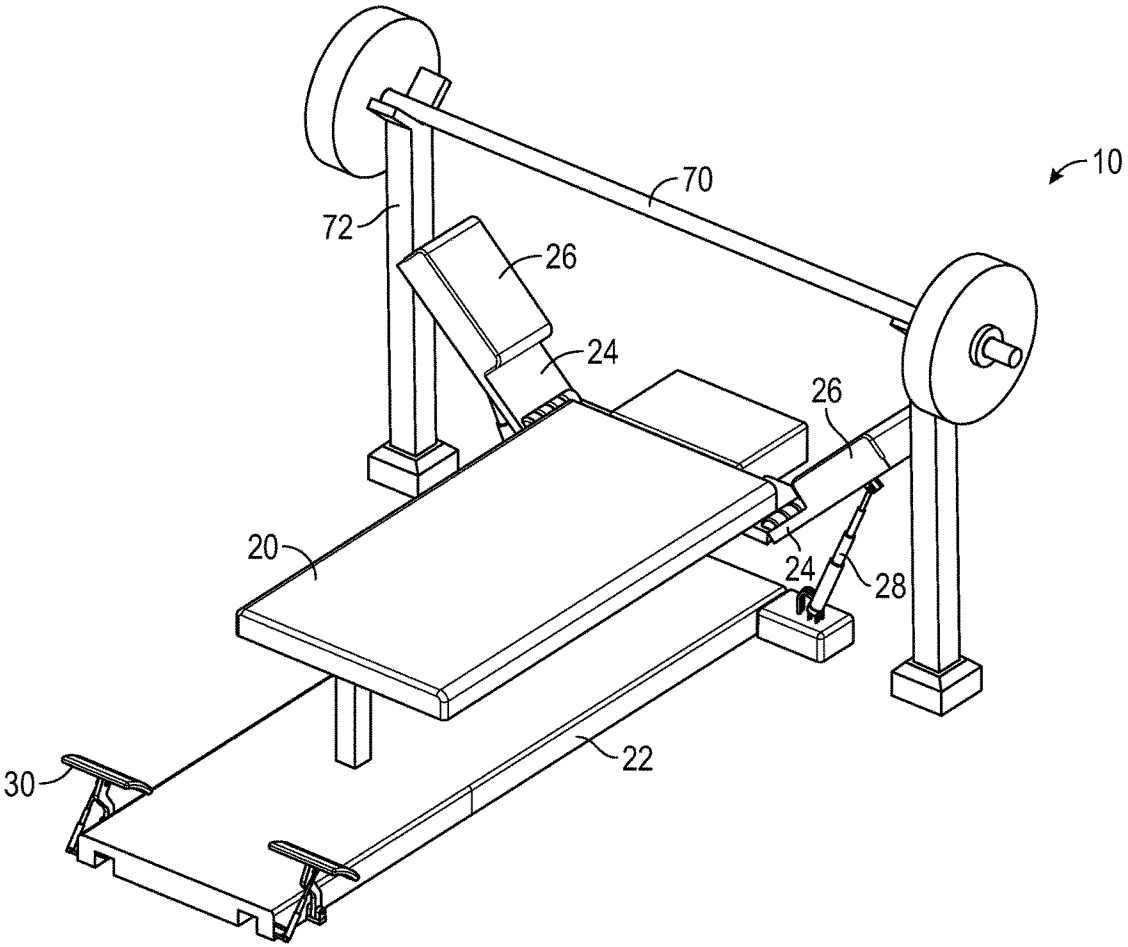
FIG. 1 is an elevation view of an embodiment.
Figure 2:
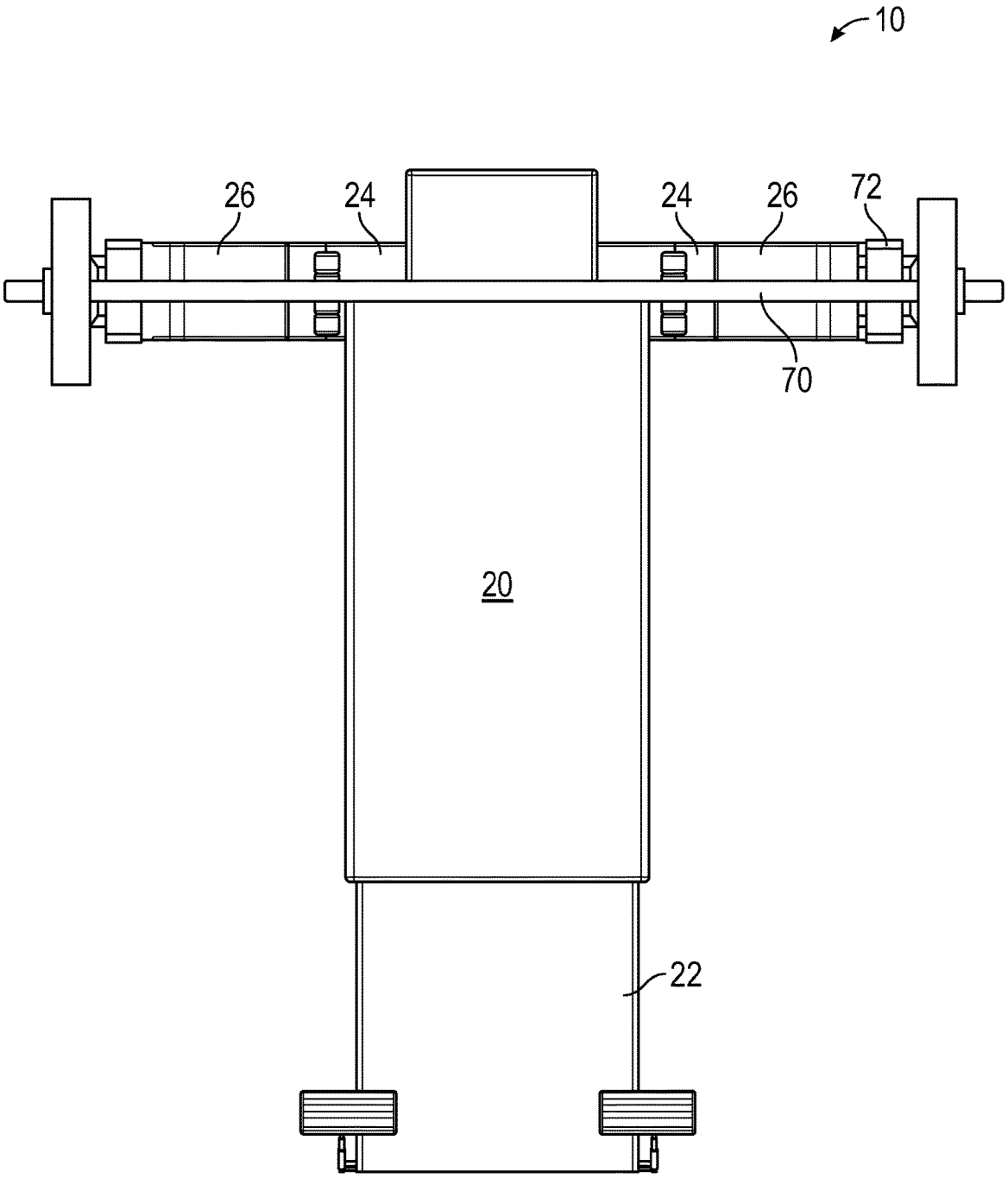
FIG. 2 is a top view of an embodiment.
Figure 3:
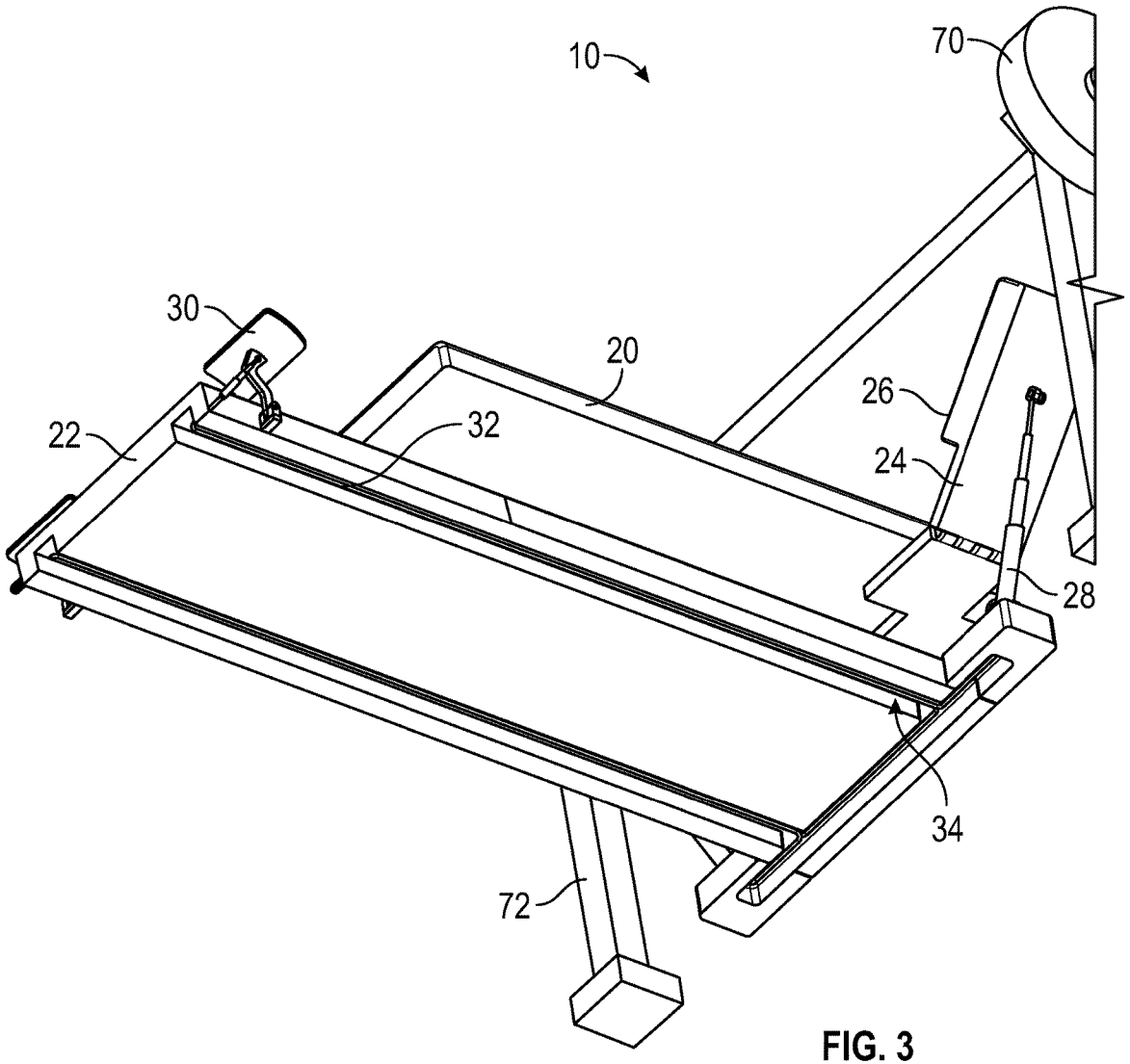
FIG. 3 is a view showing the underside of a base plate underlying a weight lifting bench.

With reference now to the drawings, and in particular FIGS. 1 through 3 thereof, example of the instant pedal activated lift advantage weight lifting bench apparatus employing the principles and concepts of the present pedal activated lift advantage weight lifting bench apparatus and generally designated by the reference number 10 will be described.

Referring to FIGS. 1 through 3 a preferred embodiment of the present pedal activated lift advantage weight lifting bench apparatus 10 is illustrated. The present pedal activated lift advantage weight lifting bench apparatus 10 has been devised to enable assisted lifting of weights 70 during bench presses without the need of pulleys or a second person acting as a spotter.

The present pedal activated lift advantage weight lifting bench apparatus 10 includes a weight lifting bench 20 disposed atop a base plate 22. The weight lifting bench 20 includes each of a pair strut members 24 disposed adjacently on either side of the bench 20 in such a position as is appropriate to underlie the dorsal side of an upper arm of a supine user laying atop the bench. Each of the pair of strut members 24 may be hingedly attached to the bench 20.

Each of a padded pair of arm assists 26 is disposed atop each of the pair of strut members 24. Each of the padded pair of arm assists 26 is likewise disposed in an appropriate position to contact the dorsal side of each of an upper arm of a supine user laying upon the bench 20 during the act of bench pressing.

Each of a pair of uplift members 28 is disposed between each of the pair of strut members 24 and the base plate 22, each of said pair of uplift members 28 movable between an extended position and a retracted position. At least one pedal member 30 is disposed upon the base plate 22 in a position appropriate to be engaged by at least one foot of a user laying supine upon the weight bench 20, said at least one pedal member 30 depressible to effect movement of each of the pair of uplift members 28 between the retracted and the extended position.

In the embodiment depicted in FIG. 3, each at least one pedal member 30 is disposed to compress a non-compressible fluid maintained interior to at least one hydraulic line 32 when said at least one pedal member 30 is depressed. The at least one hydraulic line 32 is disposed interior to at least one channel member 34 wrought in the base plate 20, and therein disposed in fluid communication with each of the uplift members 28. Thus, depression of the pedal member 30 effects compression of the non-compressible fluid in the at least one hydraulic line 32 and each uplift member 28 is forcible to the extended position. Thus, a user bench pressing weights 70 is enabled use of hydraulic force to effect an assist in returning the weights 70 to the rack 72 without the need of overhead pulleys, extraneous gear attachable to the weights 70, or a person acting as spotter. When the user needs an assist during bench pressing, said user need only employ action of the at least one pedal member 30 to effect movement of the strut members 24 and arm assists 26 and enable return of the weights 70 to the rack 72.

While the preferred embodiment herein disclosed is devised to operate by use of hydraulics enabling movement of the uplift members 28 between the retracted and extended positions, it should be recognized by anyone having skill in the art that mechanical means of leverage are likewise contemplated to effect movement of the uplift members 28 between the retracted and extended positions when the at least one pedal member 30 is depressed, such means of effecting torque well known in the art. Likewise, electrical means of communicating between the pedal member 30 and each uplift member 28 is contemplated as part of this disclosure, wherein the at least one hydraulic line 32 is a circuit disposed to effect a motorized deployment of each uplift member 28.

What is claimed is:

1. A pedal activated lift advantage weight lifting bench apparatus comprising:

a weight lifting bench;

a pair of strut members disposed laterally adjacent either side of the weight lifting bench, each of said pair of strut members disposed in a position configured to underlie upper arms of a supine user laying atop the weight lifting bench;

each of a pair of arm assists disposed atop each of the pair of strut members in a position configured to underlie a dorsal side of each of an upper arm of a supine user laying upon the weight lifting bench;

a base plate disposed underlying the weight lifting bench;

each of a pair of uplift members disposed between the base plate and one of the pair of strut members, each of said pair of uplift members moveable between an extended position and a retracted position; and at least one pedal member disposed upon the base plate in a position configured for engagement by at least one foot of a user laying supine upon the weight lifting bench, said pedal member compressible to effect extension of each of the pair of uplift members between the retracted position and the extended position wherein compression of the at least one pedal member effects extension of each of the pair of uplift members to the extended position whereby each of the pair of arm assists is forcibly configured to forcibly uplift supportively underneath the arms of a user.

2. The pedal activated lift advantage weight lifting bench apparatus of claim 1 wherein the at least one pedal member operates hydraulically to effect extension of each of the pair of uplift members.

3. A pedal activated lift advantage weight lifting bench apparatus comprising:

a weight lifting bench;

a pair of strut members disposed adjacent said weight lifting bench, each of said pair of strut members disposed in a position configured to underlie a dorsal side of an upper arm of a supine user laying atop the weight lifting bench;

each of a padded pair of arm assists attached overlying each of the pair of strut members, each of said padded pair of arm assists disposed in a position configured to underlie each of an upper arm of a supine user laying upon the weight lifting bench;

a base plate disposed underlying the weight lifting bench;

at least one channel disposed within the base plate;

each of a pair of uplift members disposed underneath each of the pair of strut members, each of said pair of uplift members movable between an extended position and a retracted position; and at least one pedal member disposed upon the base plate in a position configured to be engaged by at least one foot of a user laying supine upon the weight lifting bench; and at least one hydraulic line disposed interior to the at least one channel, said at least one hydraulic line disposed in fluid communication between the at least one pedal member and each of the pair of uplift members;

wherein the at least one pedal member is depressible to effect movement of each of the pair of uplift members between the retracted and the extended position by hydraulic action.

* * * * *